US006957463B2

(12) United States Patent
Falwell

(10) Patent No.: US 6,957,463 B2
(45) Date of Patent: Oct. 25, 2005

(54) ADJUSTABLE SUPPORT DEVICE

(76) Inventor: Robert L. Falwell, 5901 Hunter, Raytown, MO (US) 64133

( * ) Notice: Subject to any disclaimer, the term of this patent is extended or adjusted under 35 U.S.C. 154(b) by 80 days.

(21) Appl. No.: 10/757,271

(22) Filed: Jan. 15, 2004

(65) Prior Publication Data

US 2005/0155153 A1 Jul. 21, 2005

(51) Int. Cl.[7] ..... A47C 20/02
(52) U.S. Cl. ..... 5/648; 5/646
(58) Field of Search ..... 5/646, 648

(56) References Cited

U.S. PATENT DOCUMENTS

| | | | | |
|---|---|---|---|---|
| 326,185 | A | 9/1885 | White | |
| 1,147,522 | A | 7/1915 | Loomis | |
| 1,618,305 | A | 2/1927 | Paulett | |
| 2,257,876 | A | 10/1941 | Berchem et al. | 304/6 |
| 2,267,924 | A * | 12/1941 | Johnston | 5/648 |
| 2,376,787 | A | 5/1945 | Larson | 304/6 |
| 2,872,074 | A * | 1/1959 | Melerich, Jr. | 5/648 |
| 2,914,116 | A * | 11/1959 | Gohmann | 5/648 |
| 4,069,995 | A | 1/1978 | Miller | 248/118.1 |
| 4,476,885 | A | 10/1984 | Stein | 135/69 |
| 4,692,954 | A * | 9/1987 | Scott, Sr. | 5/648 |
| 4,702,520 | A | 10/1987 | Whisler et al. | 297/417 |
| 4,782,917 | A | 11/1988 | Schulz | 182/182 |
| 4,822,103 | A | 4/1989 | Stenvall | 297/411 |
| 4,997,054 | A | 3/1991 | Denny et al. | 180/331 |
| 5,536,070 | A | 7/1996 | Lemmen | 297/411.31 |
| 6,342,036 | B1 | 1/2002 | Cooper et al. | 600/224 |
| 6,764,458 | B2 * | 7/2004 | Polonchek | 5/648 |
| 2002/0154550 | A1 * | 10/2002 | Ma et al. | 365/191 |

* cited by examiner

*Primary Examiner*—Frederick L. Lagman
(74) *Attorney, Agent, or Firm*—Christopher J. Whewell

(57) ABSTRACT

Provided herein is a support stand useful for supporting various objects which is simultaneously highly variable with respect to many possible attitudes or orientations and enjoys ease and simplicity of adjustment between possible positions. A support device according to the invention simultaneously has an extremely high degree of stability and structural strength in a desired position selected by the user, is aesthetically-appealing and is simplistic enough in design to permit low-cost manufacture, thus enabling easier widespread use in various professional fields. A device according to the invention is especially well-suited to support limbs of patients such as arms and legs while undergoing a medical treatment or therapy and has a wide degree of freedom with respect to the number of possible orientations it may take on.

20 Claims, 5 Drawing Sheets

ADJUSTABLE SUPPORT DEVICE

TECHNICAL FIELD

This invention relates generally to supporting devices useful in hospital or therapy centers, useful for supporting various parts of patients undergoing a treatment or therapy. More particularly, it relates to supporting devices that are especially well suited to be positioned alongside a bed or chair and which are adapted to receive the arm or leg of a patient undergoing a medical treatment or therapy.

BACKGROUND

Various tables, support stands, and the like are known in the art as being useful for supporting limbs and other portions of human subjects undergoing a treatment or therapy, including those mentioned in the following US Patent documents. U.S. Pat. No. 326,185 teaches a chair having a ball-clamp C composed of two parts socketed to receive between them a ball and screw-nut and its sustaining cap applied to one of the parts. The handle is provided with the screw to engage with a part labeled d, and the rest. U.S. Pat. No. 1,147,522 provides a combination with a trestle having a cross beam and a supplemental cross beam in vertical alignment therewith, of a stage carrying frame comprising a pair of side pieces adapted to rest against one face of the cross beams. The side pieces have slots substantially the full length thereof with a cross piece connecting each end of the side pieces. The top cross piece is immediately over and registers with the top cross bar and the lower cross piece is below and registers with the lower cross beam. There is a means which cooperates with the cross beams and the slots to lock the frame in an adjusted position on the cross beams. U.S. Pat. No. 1,618,305 sets forth an adjustable trestle having an adjustable horse comprising a horizontal top beam, pairs of main legs connected to the end portions of the beam and depending therefrom in spaced diverging relation, cross pieces connected with the intermediate portions of the main legs. The ends of the cross pieces extend beyond the legs and auxiliary extension legs are adjustably connected with the main legs and are slidably confined between the extending end portions of the cross pieces. U.S. Pat. No. 2,257,876 discloses a sawhorse comprising two identical wooden legs disposed in an inverted v-shaped formation, a cross support, two pairs of metal brackets of generally inverted, truncated, pyramidal form, each having a flat end plate and a pair of converging flanges, and at its narrow portion, a rectilinear opening for the reception of the cross member a pair of corner brackets having surfaces disposed at right angles, one surface to engage the underside of the cross member and the other surface to engage the side plate directly under the cross member. The transversely disposed faces have perforations, fastening members passing through one to engage the underside of the cross member, and a bolt passing through the registering holes of the other two corner members and through registering openings in the pair of substantially pyramidal bracket members, and a wing nut to hold the two corner braces and two side plates in position, and additional carriage bolts clamping the two side plates in position between the legs whereby to hold the pairs of legs in inverted v-shaped formation, the cross support being mounted in the rectilinear cut out portion so flat upper portions of the two side plates. U.S. Pat. No. 2,376,787 describes an adjustable fordable trestle horse including an elevatable load supporting bar, a pair of uprights depending therefrom, a depressed roller guide within the uprights and a guide within the horse wherein the uprights are slidably mounted, foldable hinged distending leg struts including a center hinge, a pair of hinged leg members each foldable toward the other, and a guide roller mounted upon the hinge pin of the center hinge of the foldable hinged distending leg struts. The guide roller cooperates with and travels within the guides within the depending uprights to retain a true perpendicular position for the uprights to the horse in any selected position of adjustment. U.S. Pat. No. 4,069,995 teaches a limb support comprising: a) a base; b) a table spaced above the base and having a normal position relative thereto; c) a tray on the table adapted to receive an individual's limb; and d) laterally deflectable column means on the base extending therefrom to the table, and includes at least three laterally resilient, spaced column members arranged in a polygonal array and mounting the table in a predetermined attitude for movement in any horizontal direction up to a maximum, substantial displacement away from the normal position. The column members are longitudinally incompressible, yieldably biasing the table toward the normal position, and maintain the table in substantially the attitude as the table is selectively shifted in any desired horizontal direction away from the normal position in a smooth, natural motion with minimum vertical displacement. U.S. Pat. No. 4,476,885 provides an adjustable crutch assembly comprising an upper portion, a lower portion and a middle locking, adjustment and handle assembly mounted on the upper portion. The crutch assembly is of dual tubular construction with the upper ends of two main tubes of the lower portion being telescopically fitted into the open lower ends of two main tubes of the upper portion and of the middle assembly. The middle assembly comprises a lower cross member fixed to and adjacent the ends of the main tubes of the upper portion and an upper cross member slidably mounted on the main tubes of the upper portion. The upper member comprises an adjustable height handle of the crutch assembly, extendable means interconnecting the upper and lower cross members; and interlock means associated with each cross-member for adjustably and simultaneously joining the upper and lower crutch portions together in any one of a plurality of selected adjusted positions with respect to each other, and the upper cross member with respect to the lower cross member and with respect to the upper and lower crutch portions in any one of the selected adjustable positions. Simultaneous operation of the interconnecting means and of the interlock means permits either assembly or disassembly of the crutch overall or height adjustment of the crutch coupled with simultaneous adjustment of the height of the handle in the middle assembly both in a single action. U.S. Pat. No. 4,702,520 sets forth in an operator's support for a movable machine including a seat support, supporting a horizontally extending seat surface and back resting means for limiting rearward motion of an operator seated on the seat surface, and an armrest laterally offset form the seat surface and upwardly projecting beyond the same, including an improved armrest which comprises: a) a support plate fixably mounted to the seat support positioned lateral to the seat surface and extending vertically; b) a forward section pivotably mounted to the support plate including a hand controlled lever assembly fixably mounted to the forward section's top surface and first means for pivotally and selectively positioning the forward section within a defined arc; c) a rearward section adjustably mounted to the support plate including a second means for adjustably mounting the rear section to the support plate such that the rear sections angle of incline and vertical position can be selectively adjusted to a complimentary, generally linear alignment to the top surface of the forward section. The second means is comprised of a cushion support plate having a generally horizontally extending cushion fixably mounted atop thereto, the cushion support plate having a vertically, downward extending portion, the portion having a first and second vertically extending slot in opposite and generally parallel spaced apart relationship. The support plate has a forwardly located horizontal slot and a rearwardly located aperture. D) a bolt, having a bolt head, extending through the first slot in the cushion support plate cushion portion and the horizontal slot in the support plate and is secured therein by a nut; e) a friction washer placed around the bolt and between the cushion support plate portion and the support plate; and f) a knob having a threaded stem extending through the second vertical slot in the cushion support plate portion and the aperture in the support plate secured there by a nut. U.S. Pat. No. 4,782,917 describes an adjustable scaffold comprising: a) a generally rectangular frame having ends and sides, the frame having a first step section comprising one side thereof and extending partially across the width of an end of the frame, the frame including a pair of clamp sections, one connected to each end of the frame opposite the first step section, the clamp sections and the first step section defining a space between the clamp sections and the first step section, the space being in general alignment with the longitudinal axis of the frame; b) first and second pairs of legs pivotly mounted to the frame at the ends thereof, respectively, each of the legs being extensible; and c) a generally rectangular platform having top and bottom surfaces, the surfaces of the platform being at least equal in area to the surface area of the frame to provide maximum working area relative to the support of the frame, the platform including a pair of downwardly extending support arms which are complementary to the clamp sections and adapted to telescope within the clamp sections and to be secured by the clamp sections at a desired platform position. The platform is transversely closer to one side of the frame than the other when the support arms are secured by clamp sections for close access to a wall that may be adjacent the frame and also allowing access to the platform by the first step section which is inherently offset from the platform. The support arms are removable from the clamp sections and storable in the space between the clamp sections and the first step section, the platform being generally aligned and nested with respect to the frame when the support arms are stored in such space. U.S. Pat. No. 4,822,103 discloses an arm device for relieving load on parts of the human body, when performing work by hand and wrist movements, comprising: a) an attachment member for mounting the arm rest onto a chair or the like; b) an upper support for supporting the forearm and work being performed by hand and wrist movements; c) an adjustable horizontal guide rail attached to the upper support and movably disposed in longitudinal direction to provide a corresponding adjustment of the support due to the influence of a force generated when the hand is move forwards or backwards; an adjustable vertical guide rail which is movable in its longitudinal direction to provide a corresponding adjustment of the support due to the influence of a force generated by the weight of the forearm and by external forces exerted on the forearm; and d) a joint of elastic material arranged between the horizontal guide rail and the vertical guide rail. The elastic joint carries the horizontal guide rail and the support, and the elastic joint allows the horizontal guide rail to tilt about the elastic joint in order to provide corresponding adjustment of the support due to the action of forces applied on the support in front of or behind the joint via the forearm. The horizontal guide rail, the vertical guide rail and the joint are arranged to return to their initial positions when the forces have ceased. U.S. Pat. No. 4,997,054 describes a wrist rest assembly for use with a vehicle comprising: a) a vehicle cab; b) a control console mounted to the vehicle cab and having at least one implement control mechanism; c) a rest member fixed to the vehicle cab near the location of the implement control mechanism so as to support an operator's arm for manipulation of the implement control mechanism; d) a seat mounted so as to be capable of being rotated about the vehicle cab, the rest siding the operator in maintaining his arm stationary with respect to the implement control mechanism as he rotates about the cab in the vehicle seat; e) the control console is formed with a side wall and a top wall: i) an opening being formed in the side wall of the control console and a C-clamp being fixed to the side wall of the control console in the vicinity of the opening; ii) a lock knob extending through the opening in the side wall of the control console and having a bolt member attached to one end thereof. The C-clamp is formed with bolt holes aligned with the opening in the control console and receiving the bolt portion of the lock knob, the C-clamp further being formed with a guide portion. The rest is formed with an upper portion and a generally downwardly extending shaft portion, the shaft portion being received within the guide portion of the C-clamp and the lock knob being operable to lock the C-clamp about the shaft to secure the arm rest at a selected rotational and vertical position, the lock knob being capable of being loosened to allow the arm rest to be rotated or moved vertically into a new selected position. U.S. Pat. No. 5,536,070 discloses an ergonomic arm rest for a chair having a forward arm rest pad and a rear arm rest pad supported by a vertical support mechanism. The vertical support mechanism permits the vertical, horizontal and transverse adjustment of the location of the arm rest pads. The vertical support mechanism allows the position of the forward and rear arm rest pads to be reversed. The rear arm rest pad is attached to an extendable element which facilitates the displacement of the rear arm rest pad above and away from the forward arm rest pad. The forward arm rest pad is horizontally displaceable relative to the vertical support mechanism and may be angularly displaced. U.S. Pat. No. 6,342,036 describes a self-retaining vaginal retractor comprising: a) an inverted generally U-shaped base plate, the base plate comprising a generally horizontal upper member and a pair of spaced apart, generally parallel side legs extending perpendicularly downward from the upper member; b) a top vagina retracting blade removably and adjustably secured to the upper member, generally perpendicular to the upper member, the top retracting blade adjustable along the upper member and perpendicular to the upper member; and c) a plurality of cooperating side vagina retracting blades, each removably and adjustably secured to one of the base plate legs, generally perpendicular to the base plate legs, the side retracting blades adjustable along the base plate legs and perpendicular to the base plate legs.

However, of these prior contrivances, none have thus far provided a support which is simultaneously highly variable with respect to many possible attitudes or orientations. In addition, none simultaneously enjoy ease and simplicity of adjustment between possible positions. Further, none are simultaneously aesthetically-appealing to an office setting. Further, none are simplistic enough in design to permit low-cost manufacture, thus enabling easier widespread use in various professional fields. Further, none simultaneously have an extremely high degree of stability and structural strength in a desired position selected by the user. The present invention provides a support structure possessing all of these features, and more, which will become apparent to one of ordinary skill in the art after reading and understanding this specification and its appended claims.

SUMMARY OF THE INVENTION

The present invention provides a device useful for supporting various items, including portions of a human subject. According to a preferred form, a device according to this invention comprises a base portion having a first leg portion and a second leg portion. There is a first fixed vertical support having a first end portion and a second end portion. The first end portion of the first vertical support is attached to the base portion such that the second end portion of the first fixed vertical support extends upwardly in a substantially perpendicular fashion from the base portion. The first fixed vertical support further comprises a hole disposed therethrough. There is a first slidable vertical support having a first end portion, a second end portion, and a longest length dimension, which further comprises an interiorly-disposed slot oriented parallel to its longest length dimension. The first slidable vertical support is disposed so that its first end portion is in closer proximity to the base portion than its second end portion. There is a second fixed vertical support, which has a first end portion and a second end portion. The first end portion of the second vertical support is attached to the base portion such that the second end portion of the second fixed vertical support extends upwardly in a substantially perpendicular fashion from the base portion. The second fixed vertical support further comprises a hole disposed therethrough. There is a second slidable vertical support having a first end portion, a second end portion, and a longest length dimension, and which further comprises an interiorly-disposed slot oriented parallel to its longest length dimension. The second slidable vertical support is disposed so that its first end portion is in closer proximity to the base portion than its second end portion. There is a first fastening means commonly disposed through the hole in the first fixed vertical support and the slot in the first slidable vertical support. There is a second fastening means commonly disposed through the hole in the second fixed vertical support and the slot in the second slidable vertical support. There is also an upper support member which has a first end portion, a second end portion, and a length dimension. The upper support member is pivotally attached to the second end portion of each of the slidable vertical supports at a different location along the length of said upper support member. There is also a cushioned surface disposed on the upper support member.

DETAILED DESCRIPTION

Figure 1:
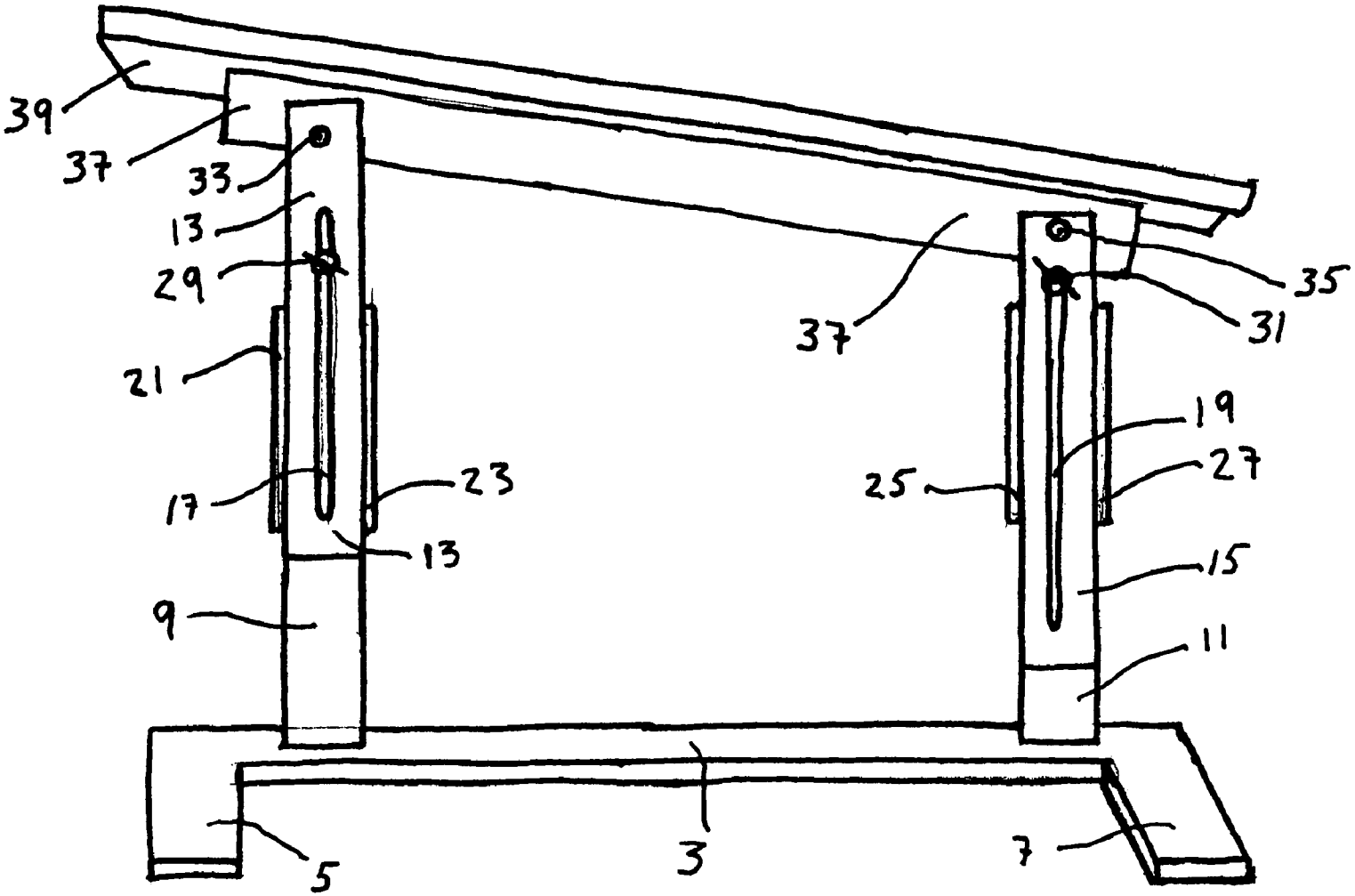
FIG. 1 shows a side perspective view of a support device according to one preferred form of the invention.

Referring to the drawings and initially to FIG. 1 there is shown a side perspective view of a support device according to one preferred form of the invention, showing the respective positions of its various components. There is a base portion 3, which has a first leg portion 5 and a second leg portion 7 attached to it so as to form a generally u-shaped construction. In an alternate embodiment, the base portion 3, and first and second leg portions 5 and 7 all comprise a single construction in a general u-shape, as in the case when such a u-shaped construct is cut from a single piece of plywood or other similar material.

There is a first fixed vertical support 9 having a first end portion and a second end portion, wherein the first end portion of the first vertical support 9 is attached to the base portion using conventional means, such that the second end portion of the first fixed vertical support 9 extends upwardly in a substantially-perpendicular fashion from the base portion 3 to which it is attached. The first fixed vertical support 9 further comprises a hole disposed through it near its second end portion. In one preferred form of the invention, the first fixed vertical support 9 comprises a 1"×2" piece of wood or other similar material. There is also a first slidable vertical support 13 having a first end portion, a second end portion, and a longest length dimension. The first slidable vertical support 13 further comprises an interiorly-disposed slot 17 oriented parallel to its longest length dimension, and the first slidable vertical support 13 is disposed so that its first end portion is in closer proximity to the base portion 3 than its second end portion. Thus, the second end portion of the first slidable vertical support 13 contains the point which is farthest away from the base portion 3 of all points on the first fixed vertical support 9 and the second slidable vertical support 13. In one preferred form of the invention, the second end portion of the first slidable vertical support 13 includes a hole disposed through it. There is a first fastening means 29 commonly disposed through the hole in the first fixed vertical support 9 and the slot 17 in the first slidable vertical support 13. Thus, the faces of the first fixed vertical support 9 and the first slidable vertical support 13 are caused to be in contact with one another and are held in position with respect to one another by the force of the first fastening means 29, which fastening means is preferably a wing nut or other convenient fastening means which is readily tightened or loosened by the user of a support according to the invention. There is also a second fixed vertical support 11 having a first end portion and a second end portion, wherein the first end portion of the second vertical support 11 is attached to the base portion using conventional means, such that the second end portion of the second fixed vertical support 11 extends upwardly in a substantially-perpendicular fashion from the base portion 3 to which it is attached. The second fixed vertical support 11 further comprises a hole disposed through it near its second end portion. In one preferred form of the invention, the second fixed vertical support 11 comprises a 1"×2" piece of wood or other similar material. There is also a second slidable vertical support 15 having a first end portion, a second end portion, and a longest length dimension. The second slidable vertical support 15 further comprises an interiorly-disposed slot 19 oriented parallel to its longest length dimension, and the second slidable vertical support 15 is disposed so that its first end portion is in closer proximity to the base portion 3 than its second end portion. Thus, the second end portion of the second slidable vertical support 15 contains the point which is farthest away from the base portion 3 of all points on the second fixed vertical support 11 and the second slidable vertical support 15. In one preferred form of the invention, the second end portion of the second slidable vertical support 15 includes a hole disposed through it. There is a second fastening means 31 commonly disposed through the hole in the second fixed vertical support 11 and the slot 19 in the second slidable vertical support 15. Thus, the faces of the second fixed vertical support 11 and the second slidable vertical support 15 are caused to be in contact with one another and are held in position with respect to one another by the force of the second fastening means 31, which fastening means is preferably a wing nut or other convenient fastening means which is readily tightened or loosened by the user of a support according to the invention.

There is an upper support member 37 which has a first end portion, a second end portion, and a length dimension. The upper support member 37 is pivotally attached to the second end portions of each of the first slidable vertical support 13 and the second slidable vertical support 15 at different locations along the length of the upper support member. The invention further comprises a surface 39 which is adapted to receive an object to be supported. In the case where the object to be supported is the limb of a human subject, it is preferred that the surface 39 includes a cushioning means, such as one of various known paddings.

The base portion 3, leg portions 5 and 7, first fixed vertical support 9, second fixed vertical support 11, first slidable vertical support 13, second slidable vertical support 15 and upper support member 37 are each in one preferred form of the invention comprised of wooden planks, such as a 1"×2"; 1"×4"; or 2"×4" pieces of oak, pine, maple, poplar, spruce, mahogany, walnut or other wood having the aforesaid features. However, the present invention contemplates the use of other materials of construction known in the art, including without limitation steel, aluminum, other metals and known alloys, composites materials such as reinforced graphites and fiberglass, thermoset polymers, thermoplastic polymers, particleboard comprising sawdust, polyurethanes, etc., as a material for construction from which these various elements of a support according to the invention may be comprised. The various elements of a support according to the invention may be connected or attached to one another using conventional means, including without limitation as brackets, nuts and bolts, rivets, nails, screws, welds, staples or resin emulsion glues, hot melt glues, epoxies, etc.

FIG. 1 also shows lateral stops 21, 23, 25, and 27 disposed on the edge portion of the fixed and slidable vertical support members, the purpose of which is for an associated pair of these lateral stops to collectively function as a guide for the movement of a slidable vertical support means with respect to a fixed vertical support means in preventing the lateral movement of the slidable vertical support with respect to the fixed vertical support. The lateral stop 27 is shown more clearly in FIG. 3 to comprise in one form a piece of wood or other functionally-equivalent material shaped in the form of a rectangular solid and attached to the second fixed vertical support 11 by means of fasteners (such as nails or screws) 42. However, to achieve equivalent functionality, the lateral stops can also each be attached to a slidable vertical support as well. In an alternate form of the invention, one lateral stop of an associated pair (such as 25 and 27) may be attached to a slidable vertical support (such as 15) and the other may independently be attached to a fixed vertical support (such as 11). According to one preferred form of the invention, there is one lateral stop present at each of the two edges of the slidable/fixed vertical support pair, as shown in FIG. 1 for both associated pairs of slidable/fixed vertical supports.

FIG. 1 shows the slidable vertical supports 13 and 15 adjusted in positions in their possible movements with respect to the fixed vertical supports 9 and 11 (respectively) to provide for the upper support member 37 to be oriented in an angled position with respect to the horizontal. This is accomplished by loosening the fasteners 29 and 31, which preferably comprise a wing nut disposed on a threaded bolt, with washers disposed between the wing nut and the slidable vertical support, and a washer disposed between the bolt head and the surface of the fixed vertical support. In such an arrangement, the wing nuts at 29 and 31 are loosened, the upper support member 37 is manually caused to be disposed in a desired orientation, during which re-positioning the slots 17 and 19 move with respect to the location of fasteners 29 and 31, and the wing nuts are subsequently tightened to rigidly maintain the upper support member 37 in its desired position. The fasteners 33 and 35 are each disposed through a common hole through the upper support member 37 and the slidable vertical supports 13 and 15 so as to render the upper support member 37 to be pivotally connected to each of the slidable vertical supports 13 and 15 at these points where fasteners 33 and 35 are located.

Figure 2:
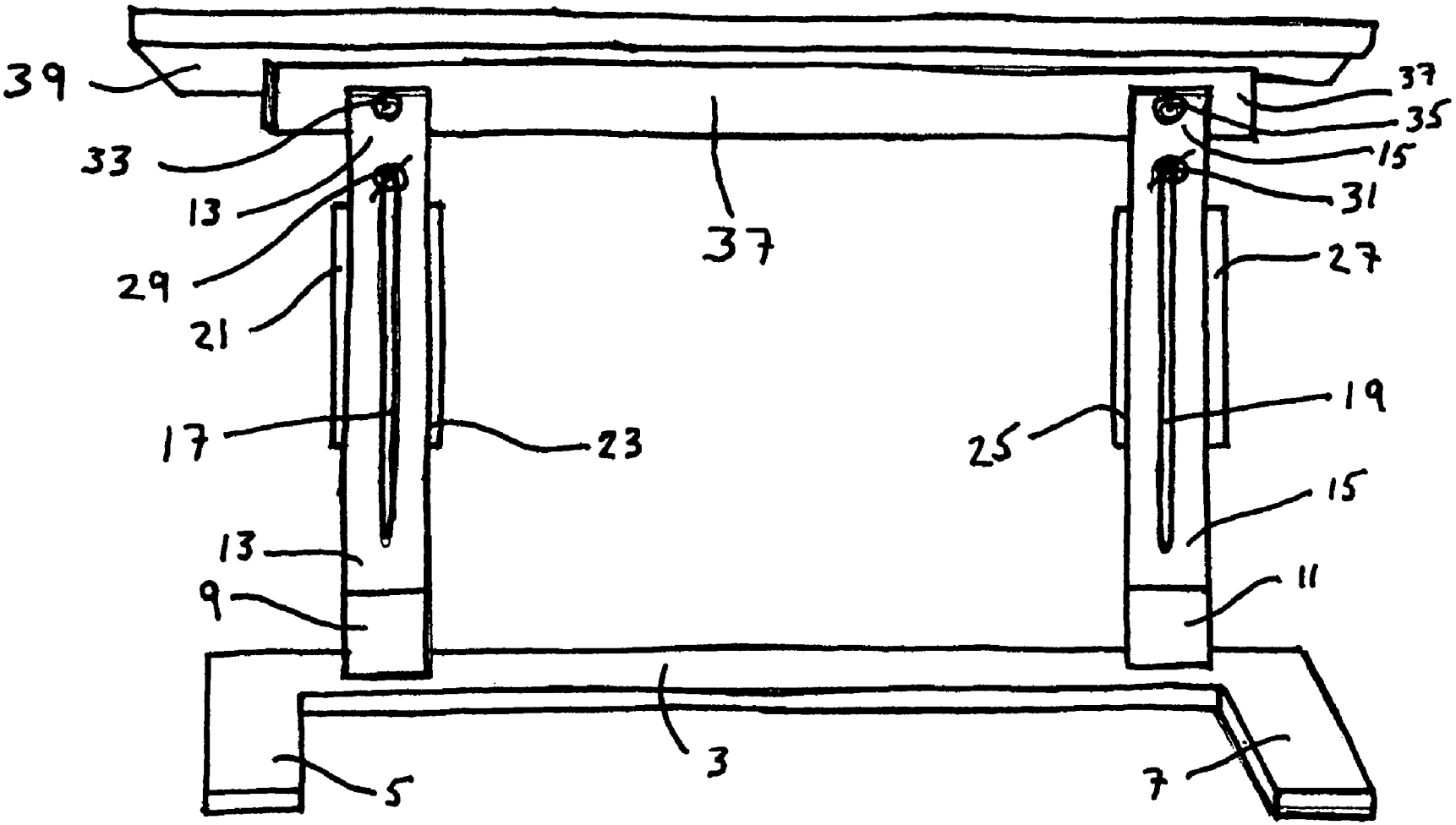
FIG. 2 shows a side perspective view of a support device according to one preferred form of the invention.

An alternate position of the upper support member 37 is shown in FIG. 2, wherein the upper support member 37 is disposed in an orientation which is substantially parallel with the horizontal. In this FIG. 2, which is a side perspective view of a support device according to a preferred form of the invention, all of the elements previously shown and described in FIG. 1 are present.

Figure 3:
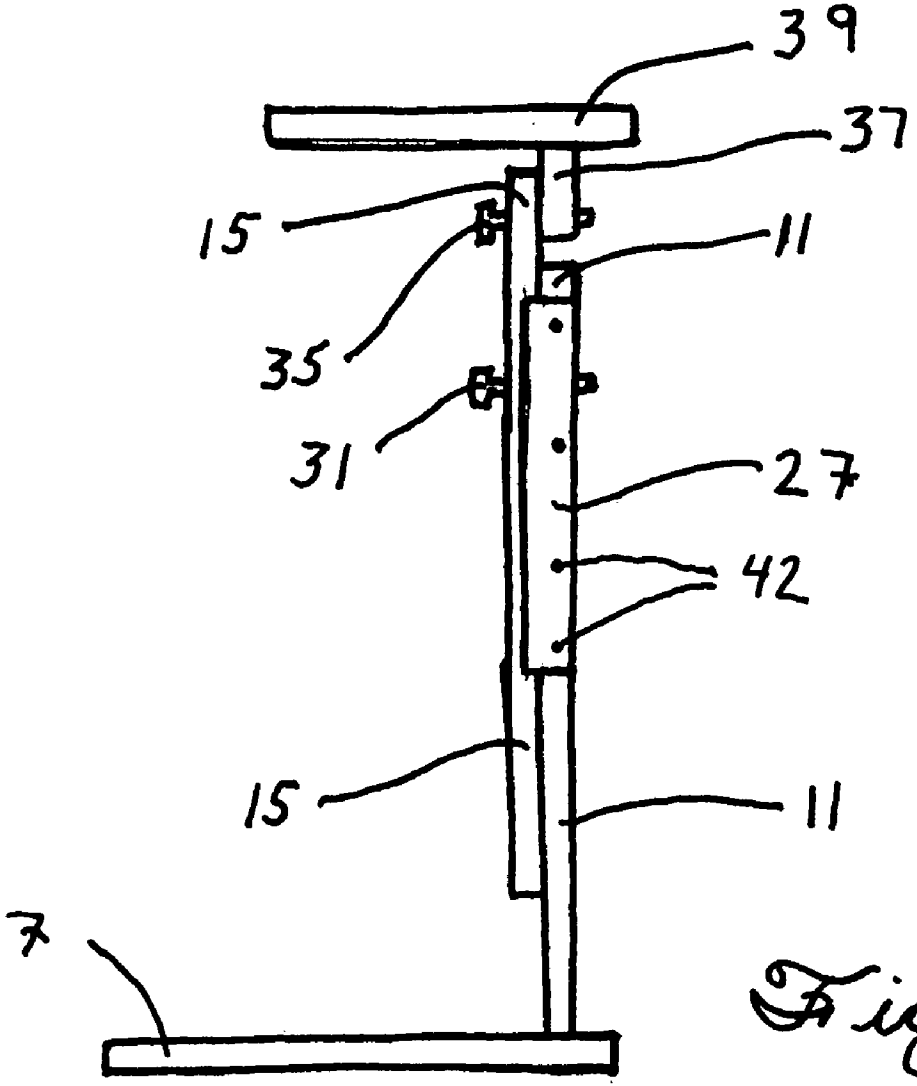
FIG. 3 shows an end perspective view of a support device according to one preferred form of the invention.

FIG. 3 shows an end perspective view of a support device according to one preferred form of the invention, such as that shown in FIG. 1 from the right side, showing the respective locations of the second leg portion 7, second fixed vertical support 11, second slidable vertical support 15, lateral stop 27 affixed to the second fixed vertical support 11 by means of fasteners 42, fasteners 31 and 35, upper support member 37, and surface 39. The end perspective view of the support device shown in FIG. 1 from the left side is in one preferred form of the invention a mirror image of the figure depicted in FIG. 3.

Figure 4:
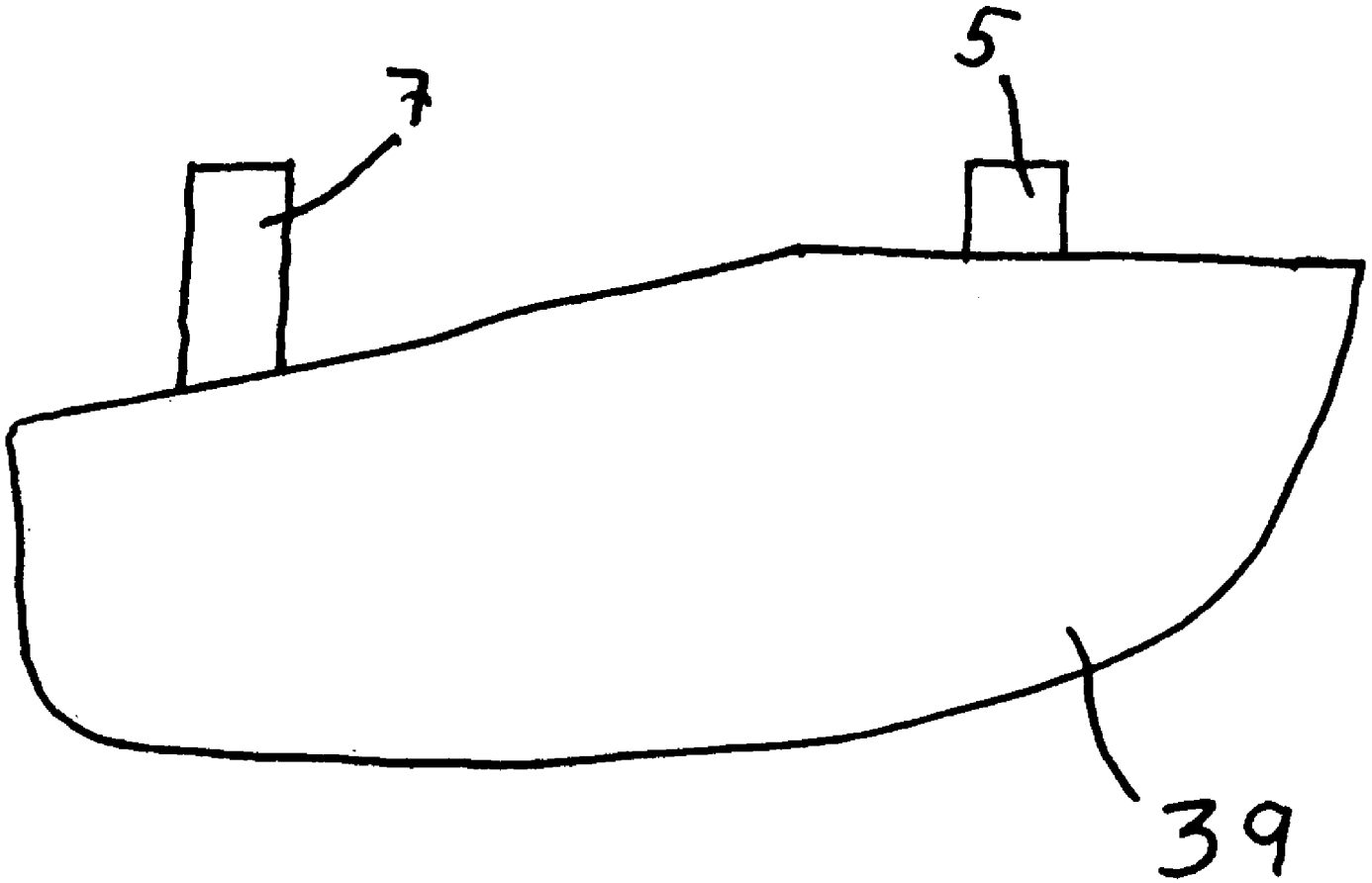
FIG. 4 shows an overhead view of a support device according to one preferred form of the invention.

FIG. 4 shows an overhead view of a support device according to one preferred form of the invention, showing the first leg 5, second leg 7, and top surface 39. The top surface 39 may be of any contour selected by the user as being most beneficial for receiving an object which is intended to be supported by the device of the invention. When the object that is desired to be supported is a human subject or a limb of a human subject such as an arm or a leg, it is preferable that the top surface comprises a cushioned surface, and may be selected from any cushioned surfaces which are known in the art.

Figure 5:
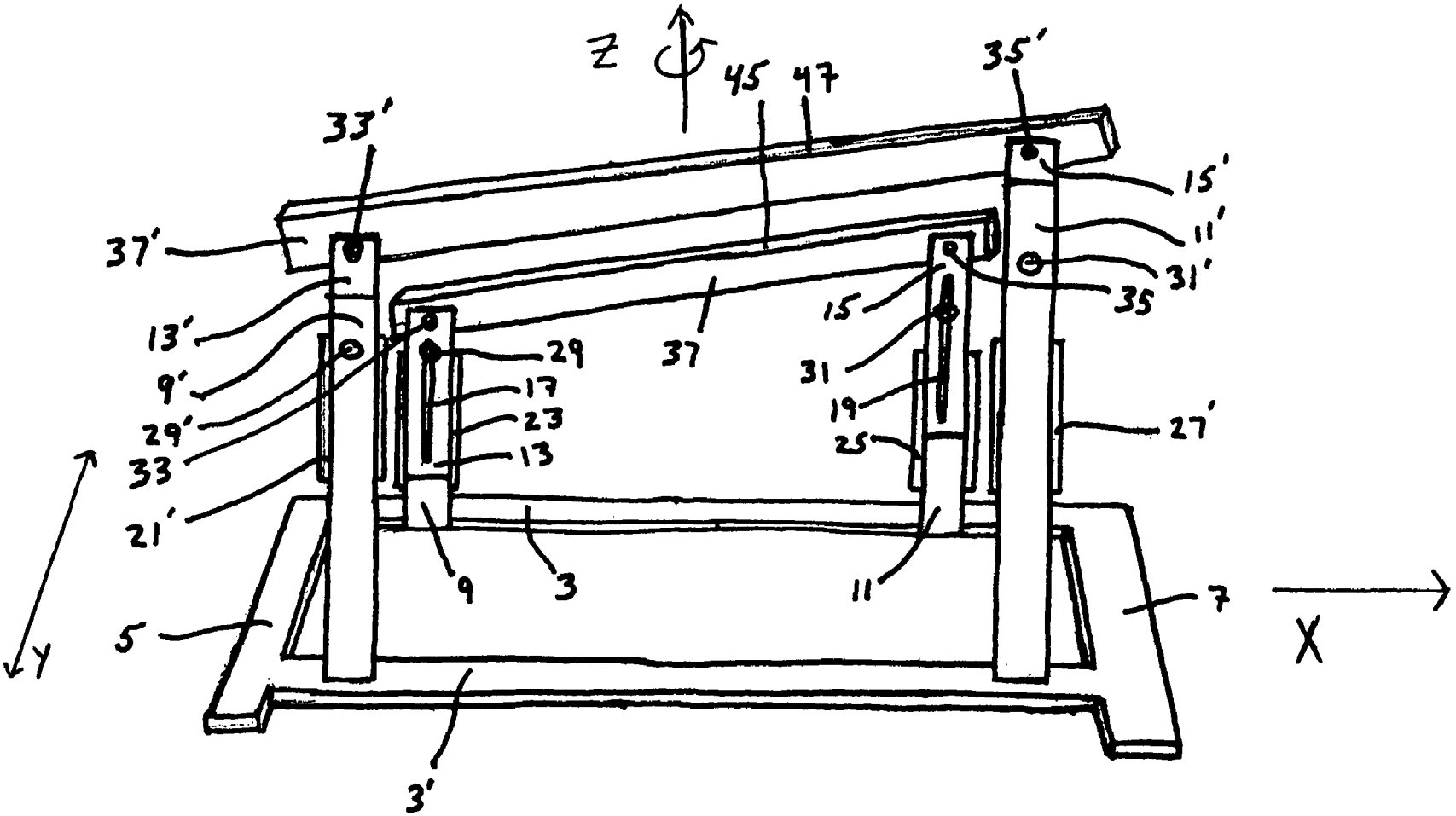
FIG. 5 shows a side perspective view of a support device according to an alternate preferred form of the invention.

FIG. 5 shows a side perspective view of a support device according to an alternate preferred form of the invention. In this FIG. 5 it can be seen that one alternate preferred form of the invention comprises two of the support devices shown in FIG. 1 connected to one another by virtue of the base portions 3 and 3' sharing first leg portions 5 and 7 in common with one another. In this embodiment are shown the various elements of the invention cooperatively connected to one another as previously set forth, including first base portion 3, second base portion 3', first leg portion 5, second leg portion 7, first fixed vertical support 9, first slidable vertical support 13, lateral stop 23, slot 17, fastener 29, fastener 33, first upper support member 37, second fixed vertical support 11, lateral stop 25, slot 19, fastener 31, second slidable vertical support 15, fastener 35, lateral stop 21', fastener 29', third fixed vertical support 9', third slidable vertical support 13', fastener 33', second upper support member 37', lateral stop 27', fastener 31', fastener 35', fourth fixed vertical support 11', and fourth slidable vertical support 15'. The third slidable vertical support 13' and fourth slidable vertical support 15' each include a slot which is preferably identical to the slots 17 and 19 of the first slidable vertical support and second slidable vertical supports. Thus, in one preferred embodiment, if the device pictured in FIG. 5 were rotated 180 degrees about the z-axis shown therein, it would appear identical to the device shown in FIG. 5, i.e., it has $C_2$ symmetry with respect to the z-axis. Each of the slidable vertical supports and the fixed vertical support to which they are attached (by means of the fastening means 29, 29', 31 or 31' as the case may be) are all attached to each another in the same fashion. In one preferred form of the invention, the fixed vertical supports are all attached to the base portion in an identical fashion. In one preferred form of the invention, the slidable vertical supports are all attached to the upper support member in an identical fashion. Thus, the construction of the fixed vertical supports and their associated slidable vertical supports naturally appear identical to one another since they are equivalent in construction, in this one preferred form of the invention.

The second upper support member 37' is pivotally attached to both the third slidable vertical support 13' and fourth slidable vertical support 15' by means of fasteners 33' and 35' respectively. In a preferred form of the invention, each of the first upper support member 37 and second upper support member 37' include a top surface 45 and 47 respectively, which is preferably flat. Such provision permits for a single top surface or tabletop to be attached simultaneously to both top surfaces 45 and 47 to yield a surface which is capable of supporting various desired articles and objects, wherein the overall support device enjoys a wide degree of flexibility with regards to the orientation of the single top surface or tabletop and an increased degree of structural strength and stability over prior art devices while providing an enhanced level of degrees of freedom with respect to adjustment.

In order to use a support device according to the invention, one loosens the fasteners at 29 and 31 (and 29' and 31' when the alternate embodiment described above is employed) enough so as to enable the slidable vertical supports to move upwards or downwards with respect to the fixed vertical supports. Then, the upper support member(s) are adjusted to a desired angle of incline and/or height from the base. Once the desired orientation of the upper support member(s) has been achieved, then the fasteners at 29 and 31 (and 29' and 31' as applicable) are tightened to yield a support device according to the invention in a stable, desired configuration. Since it is most convenient to manually loosen and tighten the fastening means 29 and 31, it is for this reason that these most preferably comprise a wing nut or other conventional fastener which is readily hand-manipulable.

The present invention also includes embodiments wherein the first end portion of at least one of the vertical supports is pivotally attached to an upper support member, and wherein the second end portion of at least one of the slidable vertical supports is attached to the base portion. Stated another way, the invention includes those embodiments in which the fixed vertical support/slidable vertical support pair(s) are inverted with respect to their being attached to the base portion or the upper support member.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. The present invention further includes all possible combinations of the features recited in the specification and/or any one of the various claims appended hereto with the features recited elsewhere in the specification and/or in any one or more of each of the remaining claims. Accordingly, the presently disclosed invention is intended to cover all such modifications, alterations, and combinations.

I claim:

1. A device useful for supporting various items, including portions of a human subject, which comprises:

a) a base portion having a first leg portion and a second leg portion;

b) a first fixed vertical support having a first end portion and a second end portion, wherein said first end portion of said first vertical support is attached to said base portion such that said second end portion of said first fixed vertical support extends upwardly in a substantially perpendicular fashion from said base portion, said first fixed vertical support further comprising a hole disposed therethrough;

c) a first slidable vertical support having a first end portion, a second end portion, and a longest length dimension, and further comprising an interiorly-disposed slot oriented parallel to its longest length dimension, said first slidable vertical support being disposed so that its first end portion is in closer proximity to said base portion than its second end portion;

d) a second fixed vertical support having a first end portion and a second end portion, wherein said first end portion of said second vertical support is attached to said base portion such that said second end portion of said second fixed vertical support extends upwardly in a substantially perpendicular fashion from said base portion, said second fixed vertical support further comprising a hole disposed therethrough;

e) a second slidable vertical support having a first end portion, a second end portion, and a longest length dimension, and further comprising an interiorly-disposed slot oriented parallel to its longest length dimension, said second slidable vertical support being disposed so that its first end portion is in closer proximity to said base portion than its second end portion;

f) a first fastening means commonly disposed through said hole in said first fixed vertical support and said slot in said first slidable vertical support;

g) a second fastening means commonly disposed through said hole in said second fixed vertical support and said slot in said second slidable vertical support;

h) an upper support member having a first end portion, a second end portion, and a length dimension, wherein said upper support member is pivotally attached to the second end portion of each of said slidable vertical supports at a different location along the length of said upper support member;

i) a surface disposed on said upper support member.

2. A device according to claim 1 wherein said base portion is substantially u-shaped.

3. A device according to claim 1 wherein said surface disposed on said upper support member comprises a cushion.

4. A device according to claim 1 wherein at least one of said first fastening means and said second fastening means comprises a wing nut.

5. A device according to claim 1 wherein at least one element selected from the group consisting of: slidable vertical supports, fixed vertical supports, base portion, leg portion and upper support member are comprised of a material selected from the group consisting of: oak, pine, maple, poplar, spruce, mahogany, walnut, steel, aluminum, reinforced graphites, fiberglass, thermoset polymers, thermoplastic polymers, particleboard comprising sawdust, and polyurethanes.

6. A device according to claim 1 further comprising at least one lateral stop means attached to a structural element selected from the group consisting of: a slidable vertical support and a fixed vertical support, wherein said lateral stop means effectively prevents lateral movement of a slidable vertical support and the fixed vertical support to which it is attached with respect to one another.

7. A device according to claim 6 wherein said lateral stop means is attached to an edge portion of said structural element.

8. A device according to claim 6 comprising two lateral stop means for each slidable vertical support and the fixed vertical support to which it is attached, wherein each of said two lateral stop means are attached to opposite edges of said structural element.

9. A device according to claim 6 comprising two lateral stop means for each slidable vertical support and the fixed vertical support to which it is attached, wherein one of said two lateral stop means is attached to a slidable vertical support and wherein the remaining lateral stop means is attached to a fixed vertical support.

10. A device according to claim 1 wherein the first end portion of at least one of said vertical supports is pivotally attached to said upper support member, and wherein said second end portion of at least one of said slidable vertical supports is attached to said base portion.

11. A device useful for supporting various items, including portions of a human subject, which comprises:

a) a first, substantially-linear base portion;

b) a second, substantially-linear base portion oriented substantially-parallel to said first base portion;

c) a first leg portion having a first end portion and a second end portion, wherein said first end portion of said first leg portion is attached to said first base portion; and wherein said second end portion of said first leg portion is attached to said second base portion;

d) a second leg portion having a first end portion and a second end portion, wherein said first end portion of said second leg portion is attached to said first base portion and wherein said second end portion of said second leg portion is attached to said second base portion;

e) a first fixed vertical support having a first end portion and a second end portion, wherein said first end portion of said first vertical support is attached to said first base portion such that said second end portion of said first fixed vertical support extends upwardly in a substantially perpendicular fashion from said first base portion, said first fixed vertical support further comprising a hole disposed therethrough;

f) a first slidable vertical support having a first end portion, a second end portion, and a longest length dimension, and further comprising an interiorly-disposed slot oriented parallel to its longest length dimension, said first slidable vertical support being disposed so that its first end portion is in closer proximity to said first base portion than its second end portion;

g) a second fixed vertical support having a first end portion and a second end portion, wherein said first end portion of said second vertical support is attached to said base portion such that said second end portion of said second fixed vertical support extends upwardly in a substantially perpendicular fashion from said first base portion, said second fixed vertical support further comprising a hole disposed therethrough;

h) a second slidable vertical support having a first end portion, a second end portion, and a longest length dimension, and further comprising an interiorly-disposed slot oriented parallel to its longest length dimension, said second slidable vertical support being disposed so that its first end portion is in closer proximity to said first base portion than its second end portion;

i) a third fixed vertical support having a first end portion and a second end portion, wherein said first end portion of said third vertical support is attached to said second base portion such that said second end portion of said third fixed vertical support extends upwardly in a substantially perpendicular fashion from said second base portion, said third fixed vertical support further comprising a hole disposed therethrough;

j) a third slidable vertical support having a first end portion, a second end portion, and a longest length dimension, and further comprising an interiorly-disposed slot oriented parallel to its longest length dimension, said third slidable vertical support being disposed so that its first end portion is in closer proximity to said second base portion than its second end portion;

k) a fourth fixed vertical support having a first end portion and a second end portion, wherein said first end portion of said fourth vertical support is attached to said second base portion such that said second end portion of said fourth fixed vertical support extends upwardly in a substantially perpendicular fashion from said second base portion, said fourth fixed vertical support further comprising a hole disposed therethrough;

l) a fourth slidable vertical support having a first end portion, a second end portion, and a longest length dimension, and further comprising an interiorly-disposed slot oriented parallel to its longest length dimension, said fiourth slidable vertical support being disposed so that its first end portion is in closer proximity to said second base portion than its second end portion;

m) a first fastening means commonly disposed through said hole in said first fixed vertical support and said slot in said first slidable vertical support;

n) a second fastening means commonly disposed through said hole in said second fixed vertical support and said slot in said second slidable vertical support;

o) a third fastening means commonly disposed through said hole in said third fixed vertical support and said slot in said third slidable vertical support;

p) a fourth fastening means commonly disposed through said hole in said fourth fixed vertical support and said slot in said fourth slidable vertical support;

q) a first upper support member having a first end portion, a second end portion, and a length dimension, wherein said first upper support member is pivotally attached to the second end portion of each of said first and said second slidable vertical supports at a different location along the length of said first upper support member;

r) a second upper support member having a first end portion, a second end portion, and a length dimension, wherein said second upper support member is pivotally attached to the second end portion of each of said third and said fourth slidable vertical supports at a different location along the length of said second upper support member; and s) a surface commonly disposed on said first and said second upper support members.

12. A device according to claim 11 wherein said base portion is substantially rectangularly-shaped.

13. A device according to claim 11 wherein said surface disposed on said upper support members comprises a cushion.

14. A device according to claim 11 wherein at least one of said first fastening means comprises a wing nut.

15. A device according to claim 11 wherein at least one element selected from the group consisting of: slidable vertical supports, fixed vertical supports, base portion, leg portion and upper support member are comprised of a material selected from the group consisting of: oak, pine, maple, poplar, spruce, mahogany, walnut, steel, aluminum, reinforced graphites, fiberglass, thermoset polymers, thermoplastic polymers, particleboard comprising sawdust, and polyurethanes.

16. A device according to claim 11 further comprising at least one lateral stop means attached to a structural element selected from the group consisting of: a slidable vertical support and a fixed vertical support, wherein said lateral stop means effectively prevents lateral movement of a slidable vertical support and the fixed vertical support to which it is attached with respect to one another.

17. A device according to claim 16 wherein said lateral stop means is attached to an edge portion of said structural element.

18. A device according to claim 16 comprising two lateral stop means for each slidable vertical support and the fixed vertical support to which it is attached, wherein each of said two lateral stop means are attached to opposite edges of said structural element.

19. A device according to claim 16 comprising two lateral stop means for each slidable vertical support and the fixed vertical support to which it is attached, wherein one of said two lateral stop means is attached to a slidable vertical support and wherein the remaining lateral stop means is attached to a fixed vertical support.

20. A device according to claim 11 wherein the first end portion of at least one of said vertical supports is pivotally attached to an upper support member, and wherein the second end portion of at least one of said slidable vertical supports is attached to one of said base portions.

* * * * *